US006390004B2

(12) United States Patent
Reinders

(10) Patent No.: US 6,390,004 B2
(45) Date of Patent: May 21, 2002

(54) DOUBLE-CHAIN STITCHING METHOD AND APPARATUS

(75) Inventor: Peter Reinders, Ochtrup (DE)

(73) Assignee: Schmale-Holding GmbH & Co., Ochtrup (DE)

( * ) Notice: Subject to any disclaimer, the term of this patent is extended or adjusted under 35 U.S.C. 154(b) by 0 days.

(21) Appl. No.: 09/766,684

(22) Filed: Jan. 17, 2001

(30) Foreign Application Priority Data

Jan. 17, 2000 (DE) ..... 100 01 611

(51) Int. Cl.[7] ..... D05B 01/10; D05B 57/02
(52) U.S. Cl. ..... 112/475.17
(58) Field of Search ..... 112/475.17, 187, 112/199, 200, 197

(56) References Cited

U.S. PATENT DOCUMENTS 3,783,810 A * 1/1974 Marforio ..... 112/200
5,467,725 A * 11/1995 Fujita et al. ..... 112/162
5,769,018 A * 6/1998 Nakano ..... 112/475.17
5,848,572 A * 12/1998 Ito ..... 112/200

FOREIGN PATENT DOCUMENTS

EP 0 156 503 10/1985

* cited by examiner

*Primary Examiner*—Ismael Izaguirre
(74) *Attorney, Agent, or Firm*—Herbert Dubno; Andrew Wilford

(57) ABSTRACT

A double chain stitch is made has by first pushing a needle carrying a needle thread down through goods to be seamed to form below a lower face of the goods a needle-thread loop and then passing a looper carrying a looper thread transversely to a stitching direction parallel to the face through the loop below the lower face to pass the looper thread through the needle-thread loop. Then the looper thread and needle-thread loop are gathered on an element below the lower face and the element is moved with the gathered needle and looper threads away from the needle and looper generally parallel to the face while advancing the goods in the direction to form with the needle-thread loop and looper thread a window. Thereafter the needle is again passed through the window and the gathered needle and looper threads are released from the element so that they engage around the most recently formed needle loop. The steps are then repeated.

7 Claims, 3 Drawing Sheets

15
DRIVE
1
7
17
CONTROLLER
3
2
4
12
11
II
DRIVE
16
I
12
11
9
L
5
6
8

DOUBLE-CHAIN STITCHING METHOD AND APPARATUS

FIELD OF THE INVENTION

The present invention relates to double-chain stitching. More particularly this invention concerns a method of and apparatus for forming a 401 double-chain stitch.

BACKGROUND OF THE INVENTION

In a double-chain stitch a needle thread is poked down by a needle through the goods being sewn to form a loop on the underside of the goods. A looper guiding a looper thread engages the loops and locks them with the looper thread, the looper moving transversely to the stitching direction. As the looper engages the needle-thread loops, they slide on it and are pulled into a so-called triangle through which the needle pokes with its next stitch to form another needle-thread loop that locks the previous stitch and that is in turn engaged by the looper.

When seaming with a double-chain stitch in a straight line there is no problem with the looper feeding the looper thread through the needle-thread loops, even at high speeds of as much as 4000 to 6000 stitches per minute. The natural advance of the goods being stitches pulls open the above-mentioned triangle so that the needle can engage accurately through it and form the interlocked double-chain stitch. If the needle does not engage through this filament triangle, stitches will be dropped and the seam will not hold.

Dropping stitches is most likely when the stitch length is very short, as the size of the opening through which the needle must engage is very small. Furthermore when the stitch is a zig-zag or follows a nonstraight path, it is possible to drop stitches at the corners. At the end of the seam, when the stitch direction is typically reversed to lock the seam, this problem is compounded as then the movement of the goods will not pull the threads into a position allowing the needle to engage through them and form the appropriately locked chain stitch.

Accordingly it has been suggested to provide a looper finger that engages the threads below the stitching plane to form a thread triangle. Such an arrangement does not work well when reverse stitching, and the mechanical structure itself is not very reliable. Furthermore the threads are often broken with such a system, particularly when working at high speed. As a result this system produces dropped stitches to such an extent as not generally to be usable.

OBJECTS OF THE INVENTION

It is therefore an object of the present invention to provide an improved method of and apparatus for double-chain stitching.

Another object is the provision of such an improved method of and apparatus for double-chain stitching which overcomes the above-given disadvantages, that is which allows non-straight and reverse stitching to be done at high speed without dropping stitches.

SUMMARY OF THE INVENTION

A double chain stitch is made has according to the invention by first pushing a needle carrying a needle thread down through goods to be seamed to form below a lower face of the goods a needle-thread loop and then passing a looper carrying a looper thread transversely to a stitching direction parallel to the face through the loop below the lower face to pass the looper thread through the needle-thread loop. Then the looper thread and needle-thread loop are gathered on a catching element below the lower face and the element is moved with the gathered needle and looper threads away from the needle and looper generally parallel to the face while advancing the goods in the direction to form with the needle-thread loop and looper thread a window. Thereafter the needle is again passed through the window and the gathered needle and looper threads are released from the element so that they engage around the most recently formed needle loop. The steps are then repeated.

With this method the triangular window is formed in every case and positioned such that the needle pokes down through it. Thus no stitches are dropped. With normal straight-ahead stitching, the element is not strictly necessary, but when stitching is along a curved path or is reversed, the element is operated to ensure that the window is formed for locking stitches. The element forms the window, so that even if very short stitches are being made or the stitching direction is reversed, the window will be created for the next loop.

The catching element is pulled in the direction in which the goods are advanced. Thus when the goods are reversed at the end of a seam the window will be created ahead, relative to the new travel direction of the goods, of the needle so it will poke down through it as required.

The element is also moved transversely to the direction opposite to the looper. This ensures that the looper thread will not come off the looper, even with a direction change, and that the appropriate window will be formed.

The catching element according to the invention is moved in an annular path synchronously with vertical reciprocation of the needle and transverse displacement of the looper. It can ride in an annular cam groove and be connected by an arm to the needle or looper drive to ensure such synchronous action. Alternately the drive for the element can be a wholly separate servosystem that only operates when needed, that is when the stitching direction changes or is reversed.

The double-chain stitching apparatus in accordance with the invention has according to the invention a needle carrying a needle thread, a needle drive for pushing the needle down through goods to be seamed to form below a lower face of the goods a needle-thread loop, a looper carrying a looper thread, and a looper drive for pushing the looper transversely to a stitching direction parallel to the face through the loop below the lower face to pass the looper thread through the needle-thread loop. An element between the lower face and the looper has a drive for gathering the looper thread and needle-thread loop at the lower face on an element below the lower face, pulling the element with the gathered needle and looper threads away from the needle and looper generally parallel to the face while advancing the goods in the direction to form with the needle-thread loop and looper thread a window, and releasing the gathered needle and looper threads from the element so that they engage around the needle loop.

The element moves in an annular path in a plane parallel to the goods and has a pair of generally parallel engagement surfaces meeting at a corner.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
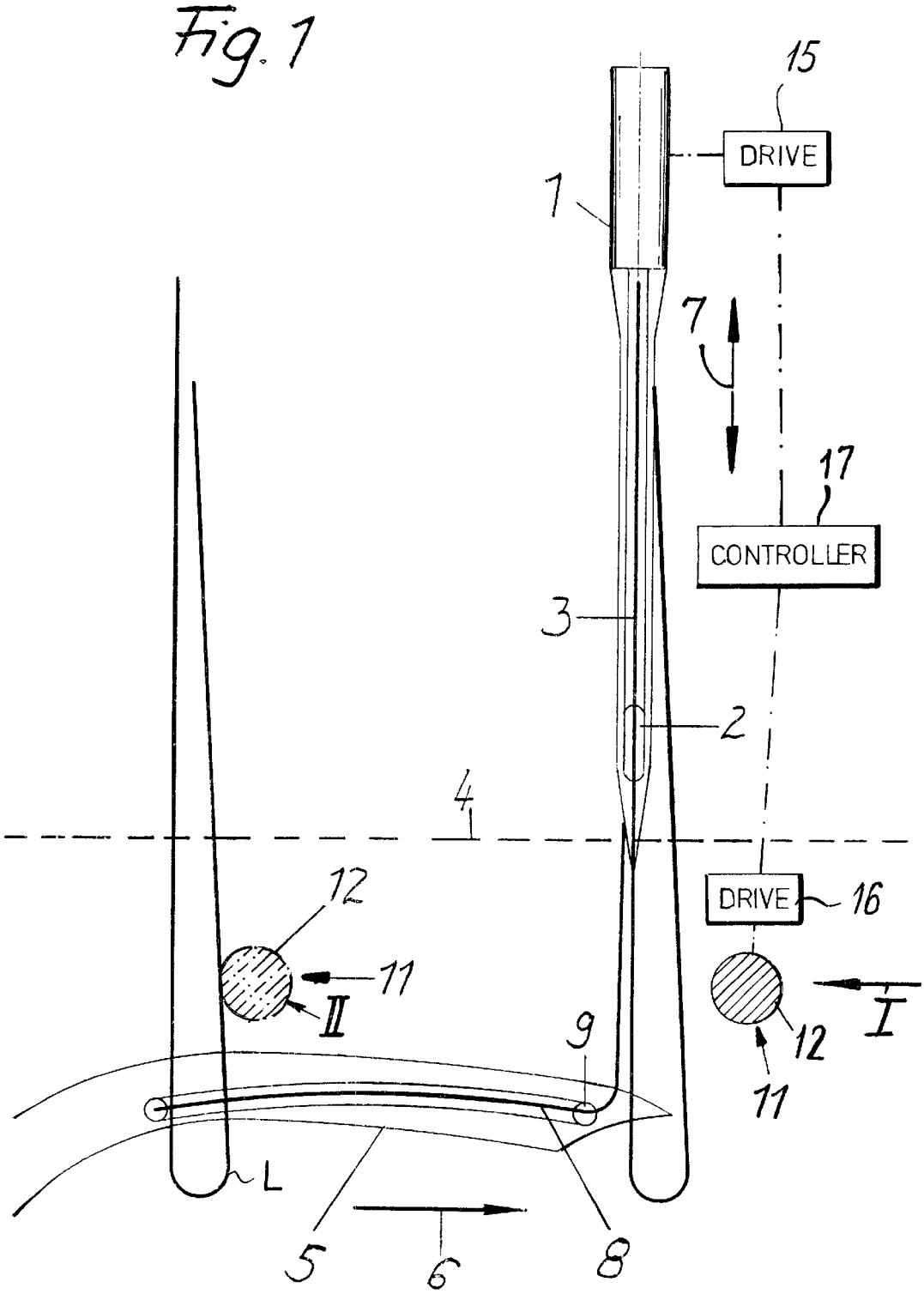
FIG. 1 is a partly diagrammatic vertical section through a sewing machine illustrating the method and apparatus of the invention.

As seen in FIG. 1 a needle 1 vertically reciprocal as shown by arrow 7 by a drive indicated schematically at 15 has an eye 2 through which passes a needle thread 3. Goods indicated schematically at 4 are advanced in a direction perpendicular to the FIG. 1 view plane and shown in FIGS. 2 and 3 and pierced by the needle 1 which thus forms needle-thread loops L beneath a lower face of the goods 4. A looper 5 underneath the goods 4 is movable as indicated by arrow 6 by the drive 15 transverse to the direction 10 and carries a looper thread 8 passing through an eye 9 so as to be threaded through the loops L formed by the needle 2 as is standard in double-chain stitching.

Figure 2:
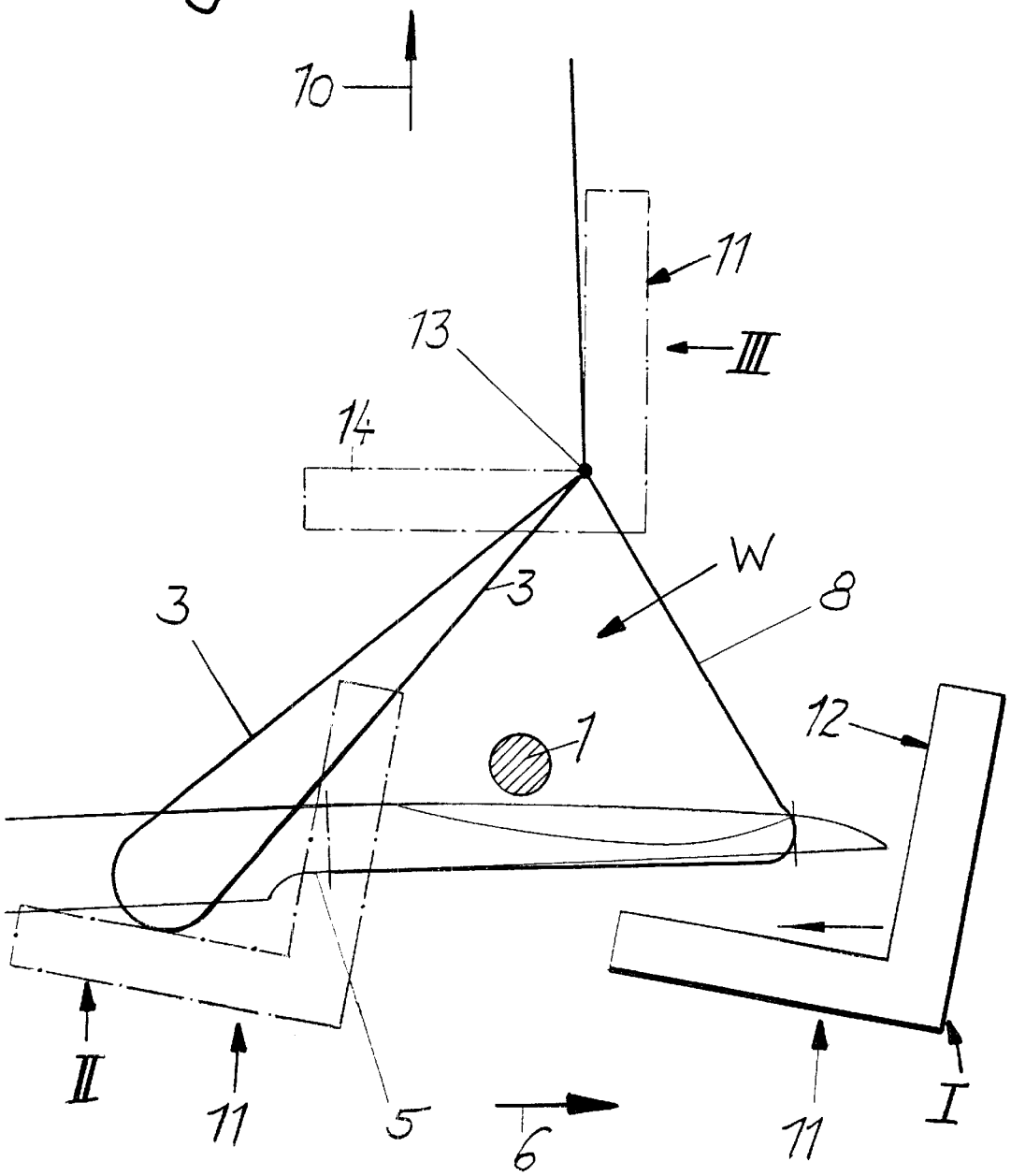
FIGS. 2 and 3 are diagrammatic top views illustrating the method of the instant invention.

According to the invention a catching element 11 formed as an L-shaped circular-section rod having a pair of inner edges 12 and 14 meeting at a corner 13 is movable in a generally annular path between positions shown at I, II, and III in FIGS. 1 and 2 and IV in FIG. 4. This movement catches and gathers together the loops L and the looper thread 8 to form therewith a triangular window W (FIG. 2) through which the needle 1 engages. This element 11 is moved by a drive 16 operated by a controller 17 synchronously with the drive 15. In practice the drive 16 can be directly coupled, as by a belt, to the drive 15 or can be a wholly separate drive that can operate generally independently of the drive 15.

The normal transport direction 10 corresponds to the normal forward sewing direction. During such advance of the goods 4, typically by means of an unillustrated presser foot holding them down against an unillustrated stitch plate and periodically stepping in the direction 10, the element 11 can in fact be out of service, stationary. During such forward stitching the window W is naturally formed by the advance of the goods 4 as they pull on the transversely spaced loops L formed by the zig-zagging needle 1.

At the end of a seam it is standard to briefly reverse the sewing direction to strengthen this end region and lock the stitching together. It is at this time the element 11 is especially useful. More particularly on sewing in other than the forward direction 10, mainly opposite thereto, the looper 5 engages the loop L formed by the needle thread 3 as shown in FIG. 1. To this end the looper 5 moves transverse to the stitching direction 10, that is in the direction of arrow 6. In this position the element 11 moves from position I to position II (see FIG. 2) so that its edge 12 engages the loop L and moves oppositely to the looper 5 in order to prevent any slipping of the loop L from the looper 5 and to produce the biggest possible window W. This happens because of the relative fast movement of the element 11 opposite to the looper direction 6 as the element 11 moves from position I to position II.

In order to form the needle thread 3 and looper thread 3 into the triangular window W the element 1 is them moved from position II into position III until the needle thread 3 and the looper thread 8 reach the corner 13 of the element 11 and are gathered there. In this manner a window W is formed between the region of the needle-thread loop L held on the looper 5, the free looper thread 8, and the looper 5 and the needle 1 can stick down through this window W. The needle thread 3 and the looper thread 8 are held n the corner 13 until the needle 1 has passed through the window W.

Figure 3:
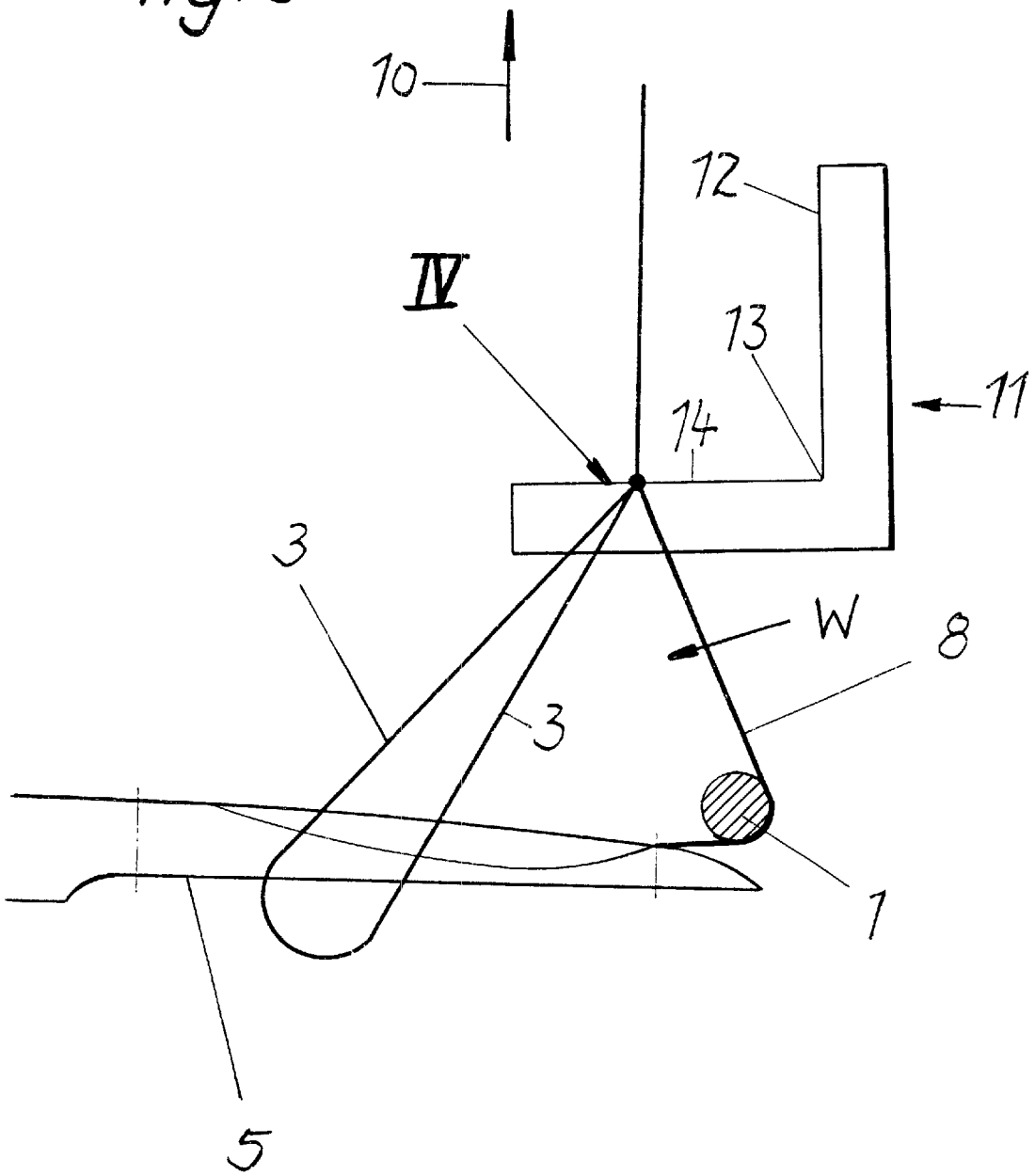

The second element edge 14 confines the gathered threads from the looper 5 so that the window W is held open until the next loop L is formed by the needle thread 3. Fast outward movement of the edge 14 allows the locked stitch to slide off the looper 5 and the stitch cycle can start over. This is shown in FIG. 3 at position IV from which position the element returns to position I.

The looper 5 then moves back against the direction 6 into its starting position. The element 11 does not have to be of L-shape, so long as it can gather the threads 3 and 8 as required. Its drive 16 can be an eccentric coupled to the needle and looper drive 15.

I claim:

1. A method of double-chain stitching comprising the steps of sequentially:

a) pushing a needle carrying a needle thread down through goods to be seamed to form below a lower face of the goods a needle-thread loop;

b) passing a looper carrying a looper thread transversely to a stitching direction and generally parallel to the face through the loop below the lower face to pass the looper thread through the needle-thread loop;

c) gathering the looper thread and needle-thread loop on a catching element below the lower face;

d) moving the element in the stitching direction with the gathered needle and looper threads away from the needle and looper generally parallel to the face while advancing the goods in the direction to form with the needle-thread loop and looper thread a window;

e) repeating step a) with the needle passing through the window;

f) releasing the gathered needle and looper threads from the element so that they engage around the needle loop formed in step e); and g) repeating steps b), c), d), e), f), and g).

2. The double-chain stitching method defined in claim 1 wherein the direction in which the goods is moved is reversed.

3. A method of double-chain stitching comprising the steps of sequentially:

a) pushing a needle carrying a needle thread down through goods to be seamed to form below a lower face of the goods a needle-thread loop;

b) passing a looper carrying a looper thread transversely to a stitching direction and generally parallel to the face through the loop below the lower face to pass the looper thread through the needle-thread loop;

c) gathering the looper thread and needle-thread loop on a catching element below the lower face;

d) moving the element transversely to the direction opposite to the looper with the gathered needle and looper threads away from the needle and looper generally parallel to the face while advancing the goods in the direction to form with the needle-thread loop and looper thread a window;

e) repeating step a) with the needle passing through the window;

f) releasing the gathered needle and looper threads from the element so that they engage around the needle loop formed in step e); and g) repeating steps b), c), d), e), f), and g).

4. The double-chain stitching method defined in claim 3 wherein the element is moved in an annular path synchronously with vertical reciprocation of the needle and transverse displacement of the looper.

5. An apparatus for double-chain stitching, the apparatus comprising:

a needle carrying a needle thread;

needle-drive means for pushing the needle down through goods to be seamed to form below a lower face of the goods a needle-thread loop;

a looper carrying a looper thread;

looper-drive means for moving the element in an annular path in a plane parallel to the goods through the loop below the lower face to pass the looper thread through the needle-thread loop;

a catching element between the lower face and the looper;

element-drive means for gathering the looper thread and needle-thread loop at the lower face on an element below the lower face, pulling the element with the gathered needle and looper threads away from the needle and looper generally parallel to the face while advancing the goods in the direction to form with the needle-thread loop and looper thread a window, and releasing the gathered needle and looper threads from the element so that they engage around the needle loop.

6. The apparatus defined in claim 5 wherein the drive means are all interconnected for synchronous movement of the needle, looper, and element.

7. An apparatus for double chain stitching, the apparatus comprising:

a needle carrying a needle thread;

needle-drive means for pushing the needle down through goods to be seamed to form below a lower face of the goods a needle-thread loop;

a looper carrying a looper thread;

looper-drive means for pushing the looper transversely to a stitching direction parallel to the face through the loop below the lower face to pass the looper thread through the needle-thread loop;

a catching element between the lower face and the looper and having a pair of generally parallel engagement surfaces meeting at a corner;

element-drive means for gathering the looper thread and needle-thread loop at the lower face on an element below the lower face, pulling the element with the gathered needle and looper threads away from the needle and looper generally parallel to the face while advancing the goods in the direction to form with the needle-thread loop and looper thread a window, and releasing the gathered needle and looper threads from the element so that they engage around the needle loop.

* * * * *